United States Patent [19]

Piteo

[11] Patent Number: 4,491,122

[45] Date of Patent: Jan. 1, 1985

[54] ANTI-REVERSE OPERATION OF SOLID STATE INDUCTIVE MAGNETO

[75] Inventor: Michael J. Piteo, Enfield, Conn.

[73] Assignee: R. E. Phelon Company, Incorporated, East Longmeadow, Mass.

[21] Appl. No.: 587,162

[22] Filed: Mar. 7, 1984

[51] Int. Cl.[3] ..... F02P 1/08

[52] U.S. Cl. ..... 123/631; 123/149 C; 123/651

[58] Field of Search ..... 123/651, 652, 602, 149 R, 123/149 C, 631, 599

[56] References Cited

U.S. PATENT DOCUMENTS 4,188,929 2/1980 Podrapsky ..... 123/599

4,401,096 8/1983 Podrapsky ..... 123/149 R X

*Primary Examiner*—Tony M. Argenbright

*Attorney, Agent, or Firm*—Chapin, Neal & Dempsey

[57] ABSTRACT

Solid state inductive magneto ignition system with anti-reverse running circuit has a switching transistor connected in circuit with the primary of an ignition coil. A control circuit is connected for cutting "off" the switching transistor to generate ignition pulses. A first by-pass circuit for shunting current from the control circuit includes a silicon controlled rectifier (SCR) which is turned "on" by discharge of voltage from a capacitor in combination with a resistor which serves as a time delay to hold the by-pass circuit "on" for the duration of a voltage pulse developed by reverse running of the magneto. A voltage polarity sensing circuit for by-passing the by-pass circuit in response to a forward running pulse includes a silicon controlled rectifier (SCR) connected in parallel with the first SCR and a choke coil and a resistor to cause the second SCR to be turned "on" by a first negative pulse developed during forward running of the magneto.

5 Claims, 3 Drawing Figures

ANTI-REVERSE OPERATION OF SOLID STATE INDUCTIVE MAGNETO

BACKGROUND OF THE INVENTION

Figures 1, 2, 3:
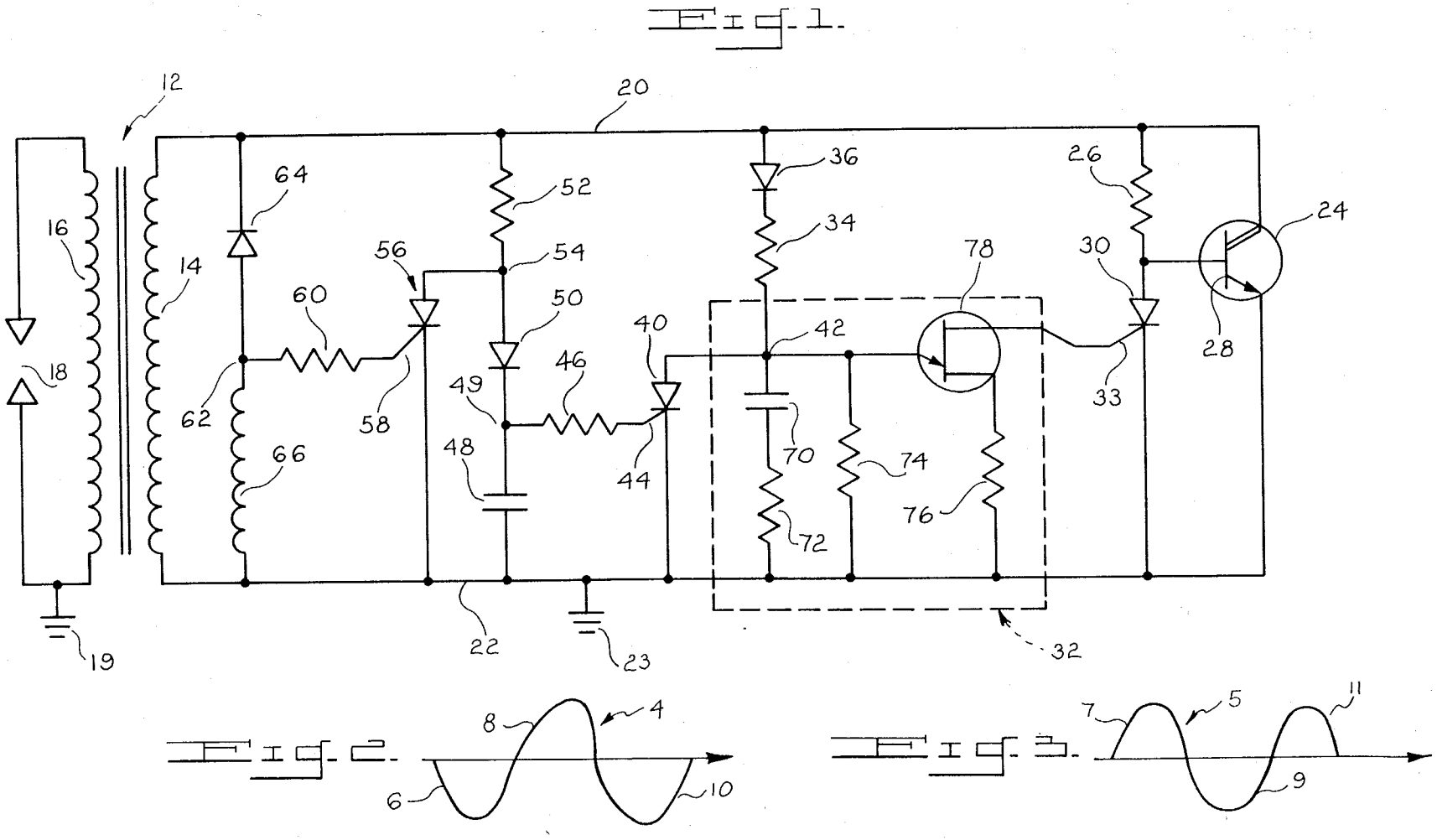

In a magneto ignition system of the inductive type, permanent magnets are usually mounted in the rim of the flywheel. During the starting of the engine, it is possible for the engine to "kick-back" if insufficient energy is expended to start it in the normal direction and it is possible that it may be rotated in the reverse direction and voltage pulses might be developed which would sustain reverse engine operation. In certain applications, such as chain saws, this can be an extremely hazardous condition. While the system embodying this invention does not prevent primary current from flowing in the primary coil circuit, it does prevent the switching transistor from interrupting such primary current flow and thereby inhibit the generation of an ignition pulse which would cause engine operation in the event of reverse magneto rotation.

U.S. Pat. No. 4,401,096 discloses a control network to prevent reverse rotation of an internal combustion engine. In this patent, the circuit designed to prevent anti-reverse running is combined with the basic timing control circuit of the system. The combination circuit includes two R/C time delay networks which, in forward flywheel rotation, establish the firing point of the ignition system and for reverse rotation, prevent ignition by premature firing of a control transistor. The drawback of this combined arrangement is that it involves a critical timing relationship which requires accurate selection of the values of the two R/C time delay networks.

In the system embodying this invention, an anti-reverse running circuit is provided which is separate and distinct from the control circuit and does not modify the normal operation of the timing control circuit.

The system is thus very reliable in operation and avoids the criticality of attempting to counterbalance the operation of a pair of R/C networks, as in the prior art.

It is the principal object of this invention to provide an improved inductive ignition system having a reliable anti-reverse running feature.

It is a further object of this invention to provide an inductive ignition system of the above type which overcomes the drawbacks of the prior art.

The above and other objects and advantages of this invention will be more readily apparent from the following description read in conjunction with the accompanying drawing in which:

FIG. 1 is a schematic wiring diagram showing an inductive ignition system having an anti-reverse running feature, and FIGS. 2 and 3 are voltage pulses illustrative of forward and reverse running voltages for a magneto ignition system.

Referring in detail to the drawing in FIG. 1 is shown a breakerless magneto inductive ignition system. In FIG. 2 is illustrated a magneto induced voltage 4 generated by forward rotation of a magneto or engine flywheel and in FIG. 3 a reverse running voltage pulse 5 is shown. With respect to FIG. 2, it will be noted that the first occurring pulse 6 is of negative polarity and is followed by a positive pulse 8 and then a negative pulse 10. In FIG. 3, the pulse 5 generated by reverse magneto rotation includes a first occurring positive pulse 7 followed by a negative pulse 9 and then a positive pulse 11.

In conventional magneto operation, voltage pulses are generated as the magneto flywheel having a permanent magnet (not shown) rotates past a core on which an ignition coil is mounted. Examples of such inductive magneto ignition systems with various coil arrangements may be found by reference to my earlier U.S. Pat. No. 3,484,677. In the present system, a voltage such as 4 is induced in the primary winding 14 of the ignition coil 12 in response to lines of flux being cut by coil 14 as the magneto rotates past the core on which the coil 12 is mounted. The polarity of the first wave portion of the generated pulse, whether negative or positive, is indicative of the direction of magneto rotation. The primary winding 14 is inductively coupled with the secondary winding 16 and a spark plug 18 for igniting the fuel-air mixture of an internal combustion engine is connected across the secondary winding 16. When current flowing in the primary winding 12 collapses, as will hereinafter be more fully described, a high voltage ignition pulse is thereby induced in the secondary winding 16 of the ignition coil, one end of which is connected to a ground terminal 19.

The primary winding is connected in circuit by leads 20 and 22 to the collector and emitter electrodes of a Darlington transistor 24 and lead 22 is connected to ground terminal 23. The Darlington transistor is turned "on" by a biasing resistor 26 connected to the base 28 of the transistor 24 and when "on", the major portion of the primary current flows through its collector/emitter junction. Resistor 26 may have a value of about 1,000 ohms to provide a base-emitter current to turn "on" transistor 24.

A silicon controlled rectifier (SCR) 30 serves as an electronic switch to turn transistor 24 "off" and to thereby cause collapse in the current flow in the primary winding with consequent generation of an ignition pulse. Ignition occurs when control circuit, indicated generally at 32, provides a current pulse to the gate 33 of SCR 30 which is thereby turned "on". Primary current flow is thereby shunted from lead 20 to grounded lead 22 through the anode-cathode junction of the SCR 30 and transistor 24 is thus turned "off". Operation of the SCR 30 is responsive to a control circuit 32 which, as shown, is disposed within a box delineated by dotted lines.

The input pulse to the control circuit 32 is derived from lead 20 through diode 36 and resistor 34. Diode 36 is poled by positive voltages so that when the voltage 8 (FIG. 2) of positive polarity reaches a predetermined level, by operation of the control circuit, SCR 30 will be gated "on". As will later be described in greater detail, and as described above, when the SCR is gated "on" transistor 24 is cut "off." The remainder of the FIG. 1 circuit components function to prevent the generation of any ignition pulse in the event the magneto is per chance rotated in the reverse direction. Reverse engine operation is prevented by shunting out the control circuit 32 so that SCR 30 cannot be gated "on". So long as SCR 30 remains "off" or nonconducting through its anode-cathode path, transistor 24 will be held "on" by biasing current flow through resistor 26 and the base 28 of transistor 24 and no ignition pulse will be generated.

To ensure against the SCR 30 being gated "on", a protective circuit is provided which includes a first by-pass circuit comprising silicon controlled rectifier (SCR) 40 connected to junction 42 which is common with the input lead to the control circuit 32 and the anode of SCR 40. The gate 44 of SCR 40 is connected by resistor 46 and capacitor 48 which together serve as an R/C time delay network. Junction 49 is connected to the cathode of diode 50 which is poled to pass positive voltages from lead 20 to capacitor 48. A resistor 52 which may have a value of about 3,400 ohms is connected from lead 20 to junction 54. When a first pulse is of positive polarity, as shown at 7 in FIG. 3, which is what occurs with reverse magneto rotation, capacitor 48 is charged by current flow through resistor 52 and diode 50. Because of the time delay for the discharge of the capacitor 48 having a value of about 1 μf through resistor 46 of about 19,000 ohms, the SCR 40 will be held "on" for the duration of the major portion of pulse 5. As a result, control circuit 32 is totally by-passed by current flow through the anode-cathode junction of the SCR 40. SCR 30 will thus remain "off" and transistor 24 will stay "on" so that no ignition pulse will be induced in the secondary winding 16 of the ignition coil 12.

The protective circuit also includes a voltage sensing circuit for by-passing the by-pass circuit through SCR 40. The sensing circuit includes another silicon controlled rectifier (SCR) 56 having its anode connected to junction 54 and its cathode connected to ground lead 22. The gate or control electrode 58 of SCR 56 is connected to a resistor 60 which, in turn, is connected to junction 62. From junction 62 there are two circuit branches, one to diode 64 which is connected to lead 20 and is poled in a direction to pass negative pulses to coil 66 which is connected to ground lead 22. Coil 66 may have an inductive value of about 0.5 Henrys and resistor 60, a value of about 100 ohms. With this circuit, whenever the magneto is rotated in the forward direction, the first pulse generated in the primary coil will be of negative polarity and will be passed only by diode 64 into the choke coil 66. As the polarity of pulse 4 starts to swing from its negative potential 6 to its positive potential 8, the current flowing in the choke coil 66 will collapse. This current collapse in coil 66 will generate a positive going pulse at the gate 58 of SCR 56 and SCR 56 will be turned "on". In a sense, the coil 66 inverts the negative pulse. The positive current pulse in the primary circuit 20 will thereby be shunted through the SCR 56 from high potential lead 20 through resistor 52, the anode-cathode path of SCR 56 to ground lead 22. Thus, the entire gate control circuit for the SCR 40 will be by-passed and a portion of the positive primary current pulse 8 may now flow from lead 20 through diode 36 and resistor 34 to charge capacitor 70 in the control circuit 32.

The control circuit may be any suitable electronic circuit for gating SCR 30 "on" when a positive voltage, such as illustrated at 8 in FIG. 2, is generated in the primary winding 14 by rotation of a magneto flywheel past the core on which the coil 14 is wound. One type of control circuit comprises capacitor 70, resistor 72 and a resistor 74 connected across the capacitor. A unijunction transistor (UJT) 78 has its emitter electrode 79 connected to junction 42. The unijunction transistor is considered an ideal device for use in SCR trigger circuits. It has the advantage of a stable firing voltage, a very low firing current and operation over a wide temperature range. One base electrode of the UJT is connected through resistor 76 to ground lead 22 and its other base electrode is connected to the gate of SCR 30.

When the voltage charge on capacitor 70 reaches a predetermined level, the UJT turns "on", at or near maximum primary current, and discharges the voltage stored in capacitor 70 through the UJT and the gate/-cathode junction of SCR 30. The SCR 30 is thus turned "on" and the current which serves to bias transistor 24 "on" is shunted away from its base 28, whereby the transistor 24 is turned "off" and current flowing in the primary winding collapses to thereby induce a high voltage ignition pulse in secondary coil 16. Whenever the voltage seen on the emitter of UJT 78 falls below about 2 volts, the UJT cuts "off" and the SCR is thus also turned "off" and transistor 24 may be thereafter biased "on" by the next positive going pulse generated in the primary winding and the cycle of operation is thereupon repeated.

In summary, in the inductive ignition system embodying this invention there are two parallel SCR paths. The first of these paths is through a first SCR 40 which is caused to turn "on" by a reverse rotation pulse, as illustrated in FIG. 3. The SCR 40 is held "on" by the time delay of R/C network 46 and 48 so that no ignition pulse can be generated whenever the polarity of the first pulse is positive polarity. The second by-pass circuit senses a first generated pulse of negative polarity and includes a second SCR 56 which is gated "on" by a negative first pulse generated in the primary coil. Whenever SCR 56 is turned "on" by choke coil 66, SCR 40 is turned "off." Thus, a portion of the current flowing in the primary lead 20 will cause operation of the control circuit in the normal manner and cause collapse of primary current through transistor 24.

Having thus described my invention, what is claimed is:

1. In an inductive breakerless magneto ignition system having an ignition transistor in circuit with the primary winding of an ignition coil to provide a solid state switch for primary current generated by said magneto and a control circuit responsive to a portion of the primary current for causing said transistor to be turned "off" for generation of an ignition pulse as a result of the open circuit collapse of primary current through said ignition transistor, an anti-reverse running system for preventing ignition pulse generation in response to reverse rotation of the magneto comprising a by-pass circuit connected across said primary winding and in parallel with said control circuit to shunt said portion of the primary current from the control circuit and including an electronic switching means and time delay means for holding said switching means "on" for a predetermined time to shunt away from said control circuit a pulse generated by reverse magneto rotation and a voltage sensing circuit for by-passing said by-pass circuit when said magneto is rotated in the forward direction.

2. In an inductive breakerless magneto ignition system as set forth in claim 1, in which said by-pass circuit includes a capacitor and resistor time delay network and means to pass voltages of positive polarity to charge said capacitor.

3. In an inductive breakerless magneto ignition system as set forth in claim 1, in which said voltage sensing circuit includes an inductor and resistor time delay network and means to pass voltages of negative polarity to said inductor.

4. In an inductive breakerless magneto ignition system as set forth in claim 1, in which said by-pass circuit includes a silicon controlled rectifier having an anode connected to the input side of the control circuit and a control electrode connected to a capacitor and resistor time delay network and a circuit for charging said capacitor, including a diode poled to pass electrical pulses of positive polarity for charging said capacitor.

5. In an inductive breakerless magneto ignition system as set forth in claim 4, in which said voltage sensing circuit includes a second silicon controlled rectifier having an anode-cathode path connected in parallel with said capacitor charging circuit and a control electrode connected to an inductor and a diode poled to pass electrical pulses of negative polarity to said inductor and a resistor in circuit with said inductor and said control electrode to provide a time delay for holding the second silicon controlled rectifier "on" for a predetermined time whenever said sensing circuit detects a first pulse of negative polarity generated by said magneto in the primary coil.

* * * * *